United States Patent [19]

Vaughan

[11] Patent Number: 4,778,081

[45] Date of Patent: Oct. 18, 1988

[54] DISPENSER FOR PRESSURIZED CONTAINERS

[76] Inventor: Donald R. Vaughan, 800 N. East St., Woodland, Calif. 95695

[21] Appl. No.: 17,713

[22] Filed: Feb. 24, 1987

[51] Int. Cl.[4] ..... B67B 7/26

[52] U.S. Cl. ..... 222/83.5; 222/91

[58] Field of Search ..... 222/81, 82, 83, 83.5, 222/91, 464, 89, 505, 511, 545; 215/322; 285/325, 327

[56] References Cited

U.S. PATENT DOCUMENTS

| | | | |
|---|---|---|---|
| 825,173 | 7/1906 | Ansley | 222/83.5 |
| 1,324,206 | 12/1919 | Nickell | 222/83 |
| 1,709,669 | 4/1929 | Jones | 222/83 |
| 1,759,459 | 5/1930 | Murdock | 222/89 |
| 1,763,924 | 6/1930 | Erwin | 222/83 |
| 1,995,098 | 3/1935 | Healy | 222/82 |
| 2,004,018 | 6/1935 | Strauss | 222/83 |
| 2,060,432 | 11/1936 | Squires | 222/89 |
| 2,082,706 | 6/1937 | Maggiora | 222/89 |
| 2,091,737 | 8/1937 | Longway | 222/83 |
| 2,159,490 | 5/1939 | Ramsay | 222/89 |
| 2,336,924 | 12/1943 | Cordis | 222/89 |
| 2,585,254 | 1/1952 | Kochner | 222/82 |
| 2,632,585 | 3/1953 | Tomasek | 222/89 |
| 2,685,978 | 8/1954 | Crockett | 215/322 X |
| 2,893,603 | 7/1959 | Franck | 222/83 |
| 3,080,094 | 3/1963 | Modderno | 222/82 |
| 3,092,291 | 6/1963 | Franck | 222/83 |
| 3,209,949 | 10/1965 | Gurtler | 222/83 |
| 3,270,919 | 9/1966 | Frangos et al. | 222/82 |
| 3,455,488 | 7/1969 | Kish | 222/82 |
| 3,655,096 | 4/1972 | Easter | 222/82 |
| 3,982,563 | 9/1976 | Kowal et al. | 137/798 |
| 4,446,987 | 5/1984 | White | 222/89 |
| 4,574,985 | 3/1986 | Sykes | 222/83.5 |

FOREIGN PATENT DOCUMENTS

| | | | |
|---|---|---|---|
| 152462 | 5/1932 | Switzerland | 222/83 |

*Primary Examiner*—Michael S. Huppert
*Attorney, Agent, or Firm*—Julian Caplan

[57] ABSTRACT

To dispense quantities of pressurized liquid (e.g., carbonated beverage) from a container of the type having a ring near the base of the neck and a cap on the neck—without removing the cap. A fitting grips the ring. A hollow screw is threaded into the top of the fitting and is turned to seal against the cap in an annular area. A tube fits through the screw, pierces the cap inside the annular area and extends inside the container, the tube being sealed within the screw. A valve on the tube dispenses desired quantities of fluid. Where the cap is exceptionally tough, a lever may be used to force the tube downward to pierce the cap.

4 Claims, 2 Drawing Sheets

DISPENSER FOR PRESSURIZED CONTAINERS

BACKGROUND OF THE INVENTION

1. Field of the Invention

This invention relates to a new and improved dispenser for carbonated beverage containers characterized by the fact that the closure for the container is not removed prior to dispensing but rather is punctured by a dispenser tube and further characterized by the fact that the device is secured to the neck of the container by means which grip the container underneath a projecting ring or flange formed integral with the container and intended primarily for use in filling, capping and loading the container.

2. Description of the Related Art

Dispensers of this general type which grip under the bead or flange formed on the container neck are old as shown in such U.S. Pat. Nos. as 2,082,706; 2,159,490; 2,060,432; 1,324,206; 2,091,737; 1,709,669; 825,173, and the like. However, the present invention differs in the simplicity of the means for attaching the dispenser to the ring or flange and in sealing the dispenser and the dispensing tube so that pressure is maintained in the container until all of the contents have been dispensed.

Other prior art references wherein the cap of the container is punctured by the dispenser include those where the dispenser grips the underneath edge of the cap, as distinguished from the flange aforementioned. These include such U.S. Pat. Nos. as 2,004,018; 1,763,924; 1,759,459; 2,336,924; 2,632,585. A feature of the present invention is that the disenser grips a permanent portion of the container rather than gripping the closure.

Dispensers employing valve means attached to the outer edge of the dispensing tube are shown in many references including those heretofore mentioned. Additional such references which show dispensing means attached to specially formed containers or specially formed containers include U.S. Pat. Nos. 1,995,098; 3,982,563; 4,446,987; 3,455,488; 3,270,919; 3,655,096; 3,080,094; 2,585,254. The present invention does not require the elaborate cooperating special container and container closure structures which are required in the aforesaid references.

SUMMARY OF THE INVENTION

The present invention is used with containers having below the screw finish or other finish of the lip of the neck a bead or flange. The container neck is closed by a screw cap or a champagne cork or other closure.

The dispenser is used with a fitting having bifurcated feet which fit under the flange or shoulder and the fitting is attached by slipping it sideways until the feet engage under the flange. The upper end of the fitting is threaded so that a hollow screw is turned until the lower end of the screw seals against the top of the closure and the feet firmly engage under the flange.

Used with the foregoing structure is an elongated tube having a sharp lower end and having at its upper end an attachment which is threaded at its lower end to mate with threads in the upper end of the screw and is also threaded at its upper end to mate with threads in the dispensing valve. The sharpened lower end of the tube is inserted into the hollow screw and the exterior of the tube seals relative to the hollow screw. By tapping the valve, the end of the tube punctures the container closure and enters the interior of the container.

The lower threaded portion of the fitting on the upper end of the tube is threaded into the hollow screw, thereby sealing the contents of the container to the valve.

From time to time the valve is opened to dispense a portion of the contents of the container.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
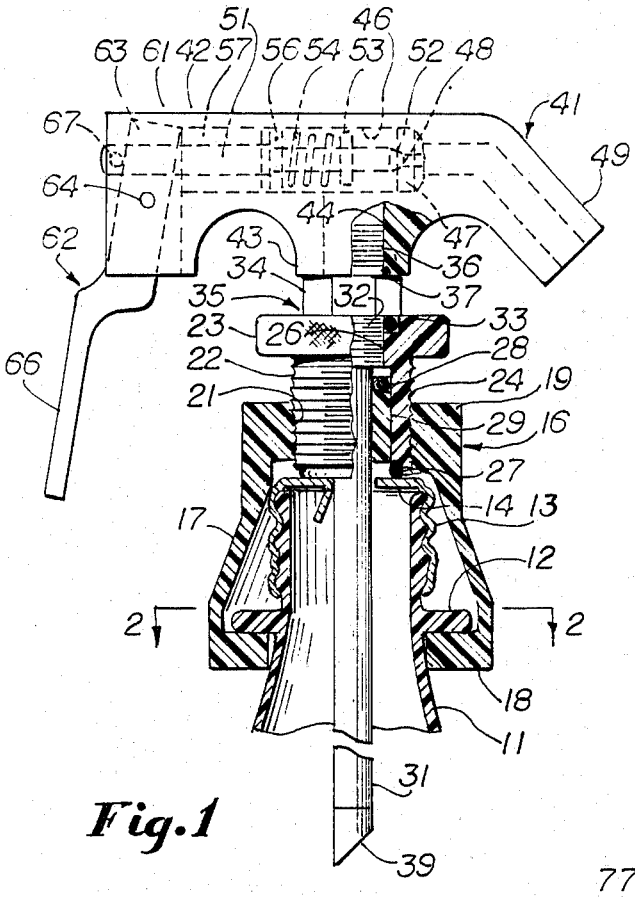
FIG. 1 is a side elevational view of one modification of the present invention partially broken away to reveal internal construction.
Figure 2:
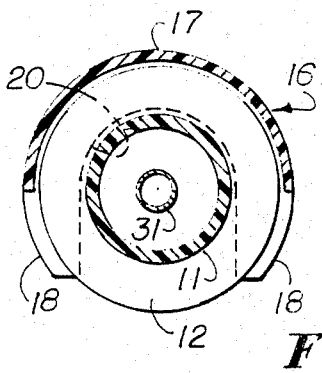
FIG. 2 is a sectional view taken substantially along the line 2—2 of FIG. 1.

Directing attention to FIGS. 1 and 2, a standard thin-walled plastic container has a neck 11 formed with a projecting ring 12 or flange located spaced downwardly from the neck finish to which the container closure or cap 13 is attached. The ring or flange 12 is used as a means of gripping the container neck 11 in order to hold the container in a filling, capping or loading machine. A feature of the invention is the fact that the dispenser of this invention grips such a ring or flange.

The finish of the neck 11 and the structure of the cap 13 is subject to considerable variation. As shown in FIG. 1, the neck 11 is externally threaded and the cap 13 is threaded to engage the neck threads. A gasket (not shown) may be interposed between the underside of the cap disc 14 and the lip of the neck 11 or other sealing means employed. In some of the modifications hereinafter described, other container and cap structures are set forth. However, almost all beverage containers commercially available employ some such flange or ring 12.

To attach the dispenser to the neck 11 a fitting 16 is employed. The lower end 17 or said fitting has bifurcated feet 18 at its lower end and an arcuate cut-away portion 20 at the base of the arms 18 so that, as best shown in FIG. 2, the feet 18 may engage under the ring 12 and the cut-away portion 20 is displaced laterally relative to the neck 11. Accordingly cut-away 20 has a radius of curvature slightly larger than neck 11 at the level of flange 2. Fitting 16 has a top portion 19 formed with a centrally threaded hole 21 connected to lower end 17 by a hollow frusto-conical portion 25.

Used with the dispenser is a hollow screw 22 having a head 23 which may be gripped with the fingers or a tool in order to screw the member 22 relative to the threads 21. Accordingly, the screw 22 has a threaded exterior 24 meshing with the threaded hole 21. The upper end of screw 22 is formed with internal threads 26 for a purpose hereinafter described. Bottom O-ring 27 is recessed into the bottom edge of screw 22 so as to engage the outer surface of top disc 14 of cap 13. There is also internally of screw 22 an upper O-ring 28 and below O-ring 28 is a guide sleeve 29.

Permanently attached to the upper end of tube 31 is a fitting 32 which may be sweated or forcefit or otherwise connected thereto. Fitting 35 has a threaded lower end 32 which meshes with threads 26. A third O-ring 33 is interposed outside the end 32 and below the head 34 of fitting 35. Head 34 may be hexagonal or other shape so as to aid in assembly of the fitting 35 to the valve 41 hereinafter described. Thus, there is a threaded upper end 36 of fitting 35 which also has an O-ring 37 to seal against the valve 41. Pointed end 39 on the lower end of tube 31 is used to puncture the disc 14 as hereinafter appears.

Various valves may be used with the dispenser. A preferred valve 41 has a valve body 42, formed with a base 43 which is, in turn, formed with internal threads 44 to mate with the threaded upper end 36 of fitting 35. Above base 43 is a valve chamber 46 and at the right hand end of chamber 46 as viewed in FIG. 1 is an abutment 47 formed with a V-shaped seat 48. Beyond the seat 48 is a downward directed spout 49 through which the beverage is dispensed.

Reciprocating in chamber 46 is a slide 51 formed at its right hand end with a needle 52 which, when it engages the seat 48 closes the valve. Fixed to the slide 51 is a collar 53 and to the left of the collar as viewed in FIG. 1 is a spring 54, the left hand end of which bears against abutment 56 fixed in the chamber 46. Thus spring 54 biases the valve to closed position. To the left of the abutment 56 is a guide sleeve 57. The outer left end 61 of valve body 42 is bifurcated. Fitting inside the bifurcations of end 61 is a bifurcated lever 62 having arms 63 disposed on opposite sides of slide 51. A hinge pin 64 passing through the arms 61 and the lever 62 permits pivoting of the lever 62. An enlargement 62 or a pin is formed in or passes through the outer end of slide 51. Thus when the user applies pressure in a counterclockwise direction to the grip 66 of lever 62, the arms 63 move to the left as viewed in FIG. 1 and engage the pin or enlargement 67 causing the slide 51 to move to the left against the force of the spring 54 and opening the valve by moving the needle 52 out of engagement with the seat 48. When the grip 66 is released, the spring 54 returns the valve to closed position.

In use, with the screw 21 turned up relative to the fitting 16, the feet 18 are moved laterally under the ring 12 until the parts reach the position best shown in FIG. 2. Thereupon the user turns the head 23 until the screw forces the O-ring 27 into tight engagement against the exterior of the cap 14. At this time the tube 31 with valve 41 preferably attached to fitting 35 is inserted in the upper end of the screw 22, the O-ring 28 sealing against the exterior of the tube 31. By rapping on the top of the valve body 42, the pointed lower end 39 of the tube 31 punctures the cap 14. The tube is pushed downward inside the neck 11 until the lower end 32 of fitting 35 may be screwed into the threaded top 26 of screw 22. At this point the device is sealed relative to the interior of the container neck 11 and there is no leakage of carbonation or liquid.

In order to dispense the contents of the container, the user depresses the grip 66 causing the slide 51 to move to the left and opening the valve by removing the needle 52 from the seat 48. After the desired quantity is dispensed through the spout 49, the grip 66 is released and the spring 54 returns the valve to closed position. Repeated dispensing may be accomplished as aforesaid until the entire contents of the container are exhausted. Thereafter the entire device may be removed by reversing the procedures heretofore described and the dispenser may be reused.

Figure 3:
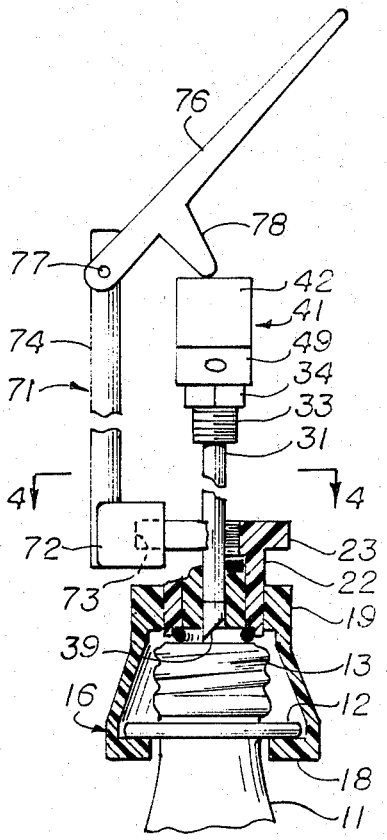
FIG. 3 is a view similar to FIG. 1 showing an auxiliary device used to apply additional downward pressure to puncture the closure.
Figure 4:
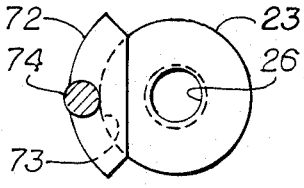
FIG. 4 is a fragmentary sectional view taken substantially along the line 4—4 of FIG. 3.

FIGS. 3 and 4 illustrate use of a driver mechanism 71 required when the user does not have the strength to force the pointed ends 39 of tube 31 through the top disc 14. Lower end 72 is formed with a pocket 73 into which a portion of the head 23 of screw 22 fits. Rod 74 extends up from lower end 72 and is connected at its upper end to lever 76 by pivot 77. Lever 76 has a foot 78 formed thereon which engages the top of body 42 of valve 41. By pushing down on the lever 76, a mechanical advantage is achieved which forces the pointed end 39 through the top disc 14.

Figure 5:
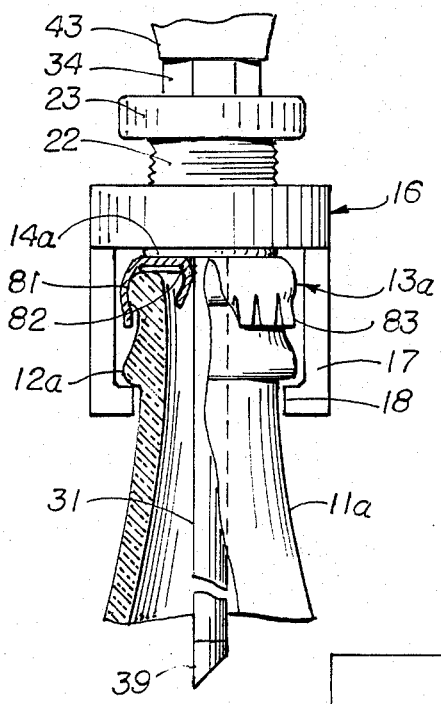
FIG. 5 is is a side elevational view showing the device used in connection with a modified type of container and closure.

FIG. 5 illustrates use of the device with a small size soda bottle. The neck **11*a* of the bottle is formed with a bead 12*a* similar in function to the ring 12 of the previous modification. Above lower bead 12*a* is an upper bead 81. The cap 13*a* is of the metal crown type having a top disc 14*a*, a cork gasket 82 under the disc 14*a* and a skirt on the periphery of the top 14*a* which is formed with crimps 83 crimping under the top bead 81. The device shown in FIG. 5 may be smaller in its dimensions than that shown in FIGS. 1–4 but is generally similar in structure. The feet 18 engage under the lower bead 12*a*. The point 39 of the tube 31 penetrates both the top 14*a* and the cork gasket 82**.

Figure 6:
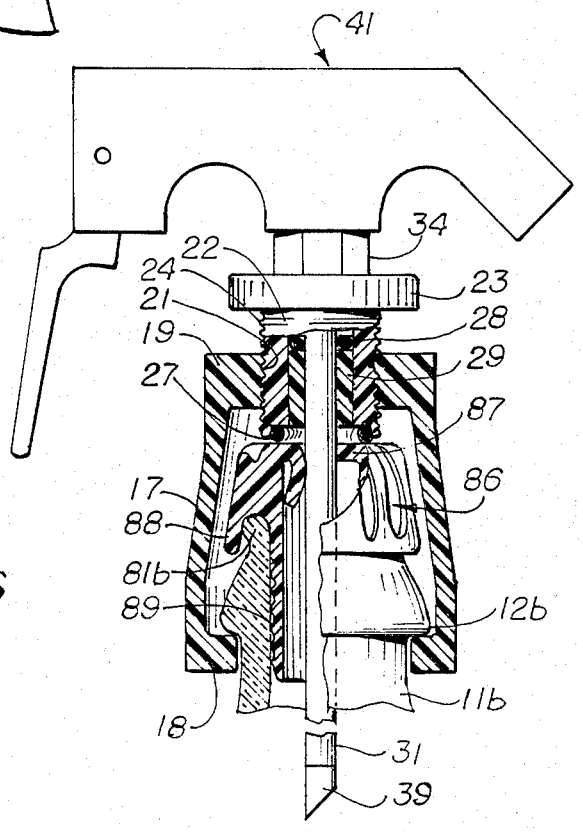
FIG. 6 is a view similar to FIG. 1 showing the device applied to a champagne type cork.

Directing attention to FIG. 6, the container is for a beverage such as champagne. The neck **11*b* is formed with a bead 21*b* under which the arms 18 engage. The champagne cork 86 has a top disc 87, an outer skirt 88 which extends around the upper bead 81*b* and an inner skirt or plug 89 which fits inside the neck of the bottle. The point 39 of the tube 31 penetrates the top disc 87**. In other respects the operation and structure of the device are the same as in the preceding modifications.

The structure shown in FIGS. 5 and 6 are similar to those of the preceding modifications and the same reference numerals followed by the subscripts a and b, respectively, are used to designate corresponding parts.

What is claimed is:

1. A dispenser for use with a container having a neck having a closure-engaging finish and an external flange spaced below said finish and a closure having a puncturable top disc and means below said disc to engage said finish, said dispenser comprising a truncated,hollow, upward-converging conical first fitting having a lower end shaped to partially encircle said neck and engage under said flange while said closure is intact and engaging said finish, an upper end formed with an internally threaded first hole; an integral hollow screw externally threaded to engage said first hole, a head for turning said screw, said head being formed with an internally threaded second hole, said screw being formed with a recessed groove in its bottom end, a first annular gasket in said groove adapted to seal against said top disc when said screw is turned inward relative to said upper end and said lower end grips under said flange and a second gasket inside said hollow screw below said second hole; a tube formed at one end with means for puncturing said top disc so that said tube may enter said container, a second fitting on a second end of said tube, said second gasket sealing against said tube when said tube is inserted through said second hole, said second fitting having a lower end formed with threads to engage said second hole and valve engagine means on its upper end; and a valve engaged by said valve engaging means, said valve having a slide manually movable between a normally closed position and an open position.

2. A dispenser according to claim 1 in which said lower end comprises a pair of feet extending outward from an arcuately curved portion, the feet and arcuately curved portion having a substantially planar top surface, the radius of curvature of said curved portion being greater than the radius of said neck at the level of said lower end.

3. A dispenser according to claim 1 in which said valve engaging means comprises an externally threaded upper end and in which said valve comprises a hollow body having a base formed with an internally threaded third hole mating with said threaded upper end.

4. A dispenser according to claim 1 which further comprises a sleeve inside said hollow screw and below said second gasket, said sleeve having an internal diameter slightly greater than the outer diameter of said tube to guide said tube through said hollow screw.

* * * * *